US009366391B2

(12) United States Patent
Oechsle et al.

(10) Patent No.: US 9,366,391 B2
(45) **Date of Patent: *Jun. 14, 2016**

(54) SPOT/FLOOD LIGHT WITH LEDS

(71) Applicants: Walter Oechsle, Berwick Springs (AU); Manfred Oechsle, Castle Hill (AU)

(72) Inventors: Walter Oechsle, Berwick Springs (AU); Manfred Oechsle, Castle Hill (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/188,705

(22) Filed: Feb. 25, 2014

(65) Prior Publication Data

US 2015/0241001 A1 Aug. 27, 2015

Related U.S. Application Data

(63) Continuation of application No. 12/707,773, filed on Feb. 18, 2010, now Pat. No. 8,680,753.

(51) Int. Cl.

| | |
|---|---|
| ***F21K 99/00*** | (2016.01) |
| ***F21V 15/01*** | (2006.01) |
| ***F21V 31/00*** | (2006.01) |
| ***F21V 29/00*** | (2015.01) |
| *F21Y 101/02* | (2006.01) |
| *F21V 23/00* | (2015.01) |
| *F21W 131/10* | (2006.01) |
| *F21V 29/83* | (2015.01) |

(52) U.S. Cl.

CPC ..... *F21K 9/1375* (2013.01); *F21V 15/01* (2013.01); *F21V 29/004* (2013.01); *F21V 31/005* (2013.01); *F21V 23/006* (2013.01); *F21V 29/83* (2015.01); *F21W 2131/10* (2013.01); *F21Y 2101/02* (2013.01)

(58) Field of Classification Search

CPC ..... F21V 31/005; F21V 15/01; F21V 23/026; F21V 29/004; F21V 29/22; F21V 29/2293; F21V 2101/02; F21K 9/1375

See application file for complete search history.

(56) References Cited

U.S. PATENT DOCUMENTS 8,680,753 B2 * 3/2014 Oechsle et al. ..... 313/46

* cited by examiner

*Primary Examiner* — Mary Ellen Bowman

(74) *Attorney, Agent, or Firm* — Michael D. Eisenberg

(57) ABSTRACT

A low voltage spot light for use as substitute for a mains voltage PAR38 reflector lamp which comprises a chamber for LED clusters with reflectors and an enclosure for an electronic power supply to step down the incoming mains voltage. The LED clusters are mounted in the central area of the heat sink within the chamber and are accessible via a removable window. The LED chamber is weatherproof ventilated to prevent condensation. The spotlight is designed for outdoor use in conjunction with the PAR38 style weather proof lamp holder but can be operated indoors from any standard E 27 lamp holder.

20 Claims, 1 Drawing Sheet

SPOT/FLOOD LIGHT WITH LEDS

FIELD OF THE INVENTION

The present invention relates to spotlights and more particularly to a low voltage spotlight which can be used as a replacement for a standard mains voltage parabolic aluminised PAR38 reflector lamp for outdoor use. Mains voltage is the supply voltage as provided by the Electricity Supply Authority, typically: 110 or 220V 60 Hz USA, 230V 50 Hz Europe, 240V 50 Hz Australia.

BACKGROUND OF THE INVENTION

A standard mains voltage spotlight widely used throughout the world is the PAR38 which consists of an incandescent light source usually of 120 to 150 watt rating mounted within a sealed glass enclosure. Their low installation costs—low purchase price and simple installation in conjunction with the PAR38 style lamp holder—have made it the most widely used spot light for ratings up to 150 W and outdoor applications. However being incandescent lamps their big disadvantages are low efficiency with high power consumption short service life Dangerously high surface temperatures.

Governments are now requesting the replacement of incandescent lamps with more efficient light sources.

Numerous designs of adaptor lights to replace incandescent lamps are available, however none of them entails a compact weatherproof fitting, which uses LEDs as light source and can be used in a weatherproof PAR38 style lamp holder as a substitute for PAR38 reflector lamps.

The spotlights which are the subject of this invention satisfy these difficult criteria and the term 'spotlight' as used throughout this specification includes within its scope lights, which are commonly referred to as 'floodlights'.

In my Australian Patent No. 677927, and U.S. Pat. No. 5,839,822, I describe a spotlight that permits a 120 W PAR38 lamp to be replaced with a 50 W ELV IRC halogen lamp.

Although fluorescent lamps are more efficient than ELV halogen lamps, they are not ideal as substitutes for spotlights where concentrated, natural, brilliant light with a full colour spectrum is required. With their large illuminated surface not all generated light can reach the reflector and therefore the efficiency is reduced. Their service life is only about 20% of the service life of LEDs and they produce dangerous industrial waste containing mercury. Also their service life is only about 5 times longer and they produce much industrial waste on replacement.

SUMMARY OF THE INVENTION

The invention entails a low voltage spotlight comprising two weatherproof enclosures separated by an air gap.

The rear end enclosure is made from plastics and houses an electronic power supply with insulated switch mode transformer for the mains voltage input and a constant current DC output for the LEDs with protection. The power supply is embedded in permanent elastic potting which in the plastics enclosure provides double insulation. The lid of this enclosure has a rim flange surrounding the forward end to accommodate the adhesive used for assembly and 3 integrated spacers which connect the 2 enclosures and provide a path for leads from the power supply to the LED cluster. The rear end at this enclosure has a mounting base win an Edison screw cap for fitting into the socket of a mains voltage PAR38 weather proof lamp holder. For indoor applications the spotlight can be operated from any standard E27 lamp holder.

The front end enclosure is made from Aluminium alloy and consists of a top chamber which houses the LED cluster with reflectors or collimators and a lower tray with a well protected ventilation vent in its centre. A heat sink dish made from 3 mm Aluminium alloy is clamped between the two sections. The one piece heat sink has holes for internal ventilation and dark coating for good emissivity except in its central area where the LED cluster is mounted. The front of the chamber is enclosed by a removable transparent cover attached via an elastic weather proof annular seal with a dust and insect proof vent. The position of the vent can be adjusted by rotation of the transparent cover. Heat is conducted from the Led cluster into the dish and emitted from its surface to ambient air for cooling.

Currently 14 W suffice to produce a light beam comparable to a 100 W PAR38 lamp.

The weatherproof ventilation of the front end Led chamber prevents condensation.

BRIEF DESCRIPTION OF THE DRAWINGS

The invention is now described with reference to the accompanying drawings in which.

DETAILED DESCRIPTION WITH RESPECT TO THE DRAWINGS

Figure 1:
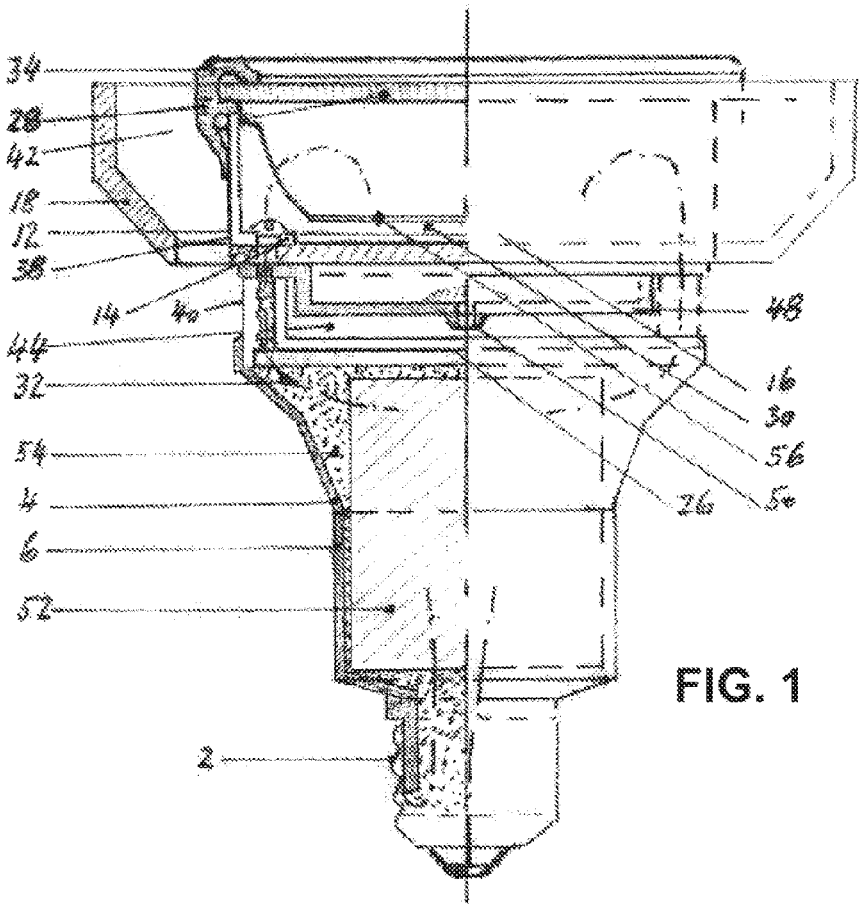
FIG. 1 is a section through a spot light.
Figure 2:
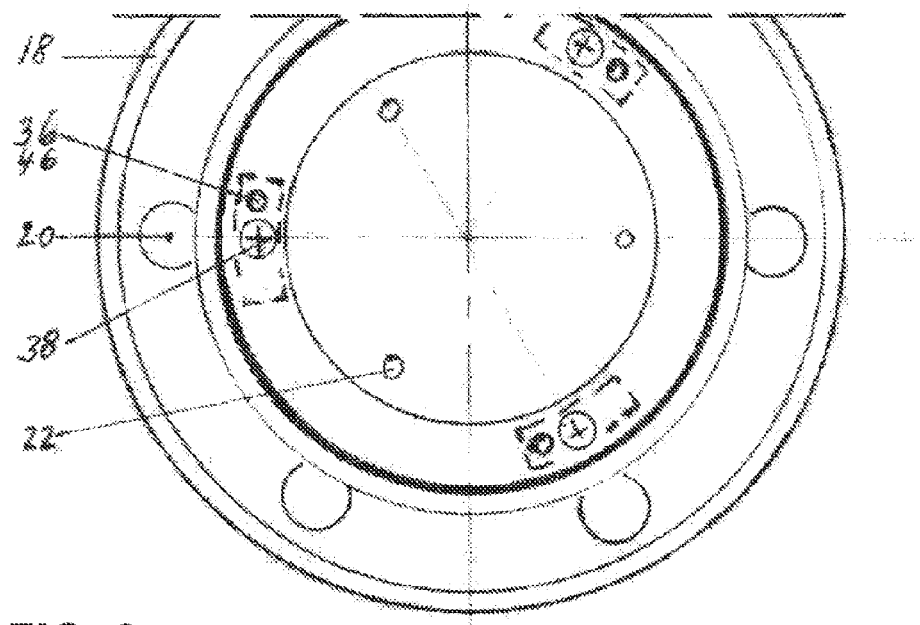
FIG. 2 is a plan of the spot light of FIG. 1 with the LEDs, glass cover and chamber seal removed.

Referring now to the drawings, a LV spot light intended as a replacement for an existing PAR38 lamp comprises a standard Edison screw cap 2 mounted at the corner end of a frusto conical housing 4 which merges into a cylindrical shape 6. This housing 4/6 is made from UV stabilised plastics and contains the electronic power supply 52. The outer profile of the casing from the base 2 to a position adjacent the transition from the conical housing 4 to the cylindrical shape 6 matches the profile of existing PAR38 lamps, thus permitting the spot light to be fitted into an existing PAR38 lamp holder which consists of a tabular socket with an annular seal interposed between the lamp holder and the conical housing to form a weather—and dust-proof seal between the spot light and the lamp holder. This arrangement protects the electrical contact area from contamination.

At the opposite end of the spot light the LED chamber 12 made from Aluminium alloy with circular flange 14 seats on the central portion of Aluminium dish 18. The dish is 120 mm at diameter and apart from the central portion 16 portion 16 it is powder coated black. The base of the dish outside the collar 12 has 6 evenly spaced holes 20, about 10 mm in diameter for ventilation cooling and drainage.

The circuit board supporting a cluster of LEDs lies inside circular flange 14. Dependent on the design of the LED cluster and the specification of the supplier, they are either mounted on base plates for connection onto the heat sink 18 with screws or with double-sided temperature conducting tape. The collar 12 creates the LED chamber 30 in to which the LEDs emit heat. The chamber is closed off by glass cover 42 held in place by rim seal 34 which contains a single dust and insect protected vent 28. The dish also has a trio of passages 46 which allow electrical leads 42 to access the LEDs and holes 22 for internal ventilation.

The flange 14 is attached to the central portion 16 of the dish by three screws 38. Each screw passes through the dish into an arcuate spacer 40 which extends from a circular lid 26. The spacers are about 11 mm long and create an air gap 44 between the lid 26 and the underside of the lower tray 48. This permits the option for weather protected ventilation. Adjacent to each screw hole in the spacer is a passage 46 which aligns with a matching passage 36 in the dish. These holes lead the wires 32 from the power supply 52 to the LED cluster.

The circuit tray 48 is locked into position between the spacers 40 and the underside of dish 18. The well protected centre of the tray 48 has a vent opening with internal filter 50 to provide dust and insect protected ventilation.

The contact surfaces between flange 14, dish 18 and tray 48 are treated with heat sink compound to ensure reliable heat transfer.

The interior of the cylindrical housing 6 accommodates as electronic power supply 52 which steps the incoming voltage down to the voltage required by the LED cluster. The power supply 52 is in the form of an insulated switch mode transformer for the AC input combined with a constant current DC output for the LEDs, including protection.

The metallic LED chamber consisting of upper body 12 and lower tray 48 optimises the cooling surface of the heat sink. The chamber is accessible via the removable window 42. This permits replacement of the LEDs with alternative types such as ones with different efficiency, different colours or otherwise different characteristics. It is a commercial decision to either use multi-element LED modules in combination with commercially available reflectors, a common reflector 56, or LEDs with integrated collimators to generate the required light beam. The common reflector 56 is installed by, for examples, clamping it under a seal.

Naturally the best efficiency is achieved with the lowest possible operating current and an increased number of LEDs.

The constant current power supply 52 is rated for an ELV output up to 24V. The input is universal for 90 to 240V, 47 to 64 Hz for ambient temperatures of −40 to +50° C. with protection against short circuit, over current and over voltage. It is encapsulated in permanent elastic potting 54 and meets international safety requirements.

In an advantage, the invention provides superior efficiency with low power consumption.

In another advantage, the invention provides long service life—only limited by the power supply to about 50,000 hrs.

In another advantage, the invention provides relatively low, non-dangerous surface temperatures.

In another advantage, the invention is light weight, below 400 g.

In another advantage, the intensive development of LEDs will not only improve the efficiency resulting in reduced power consumption but will result in cost reductions as more applications will result in higher production quantities.

In another advantage, the LEDs emit about 50 lumens/watt of warm white directional light at current state of art.

In another advantage, the LED chamber is weather proof ventilated to prevent condensation.

In another advantage, the LEDs can be changed because they are accessible through the removable window.

In still another advantage, the spot light can be used with existing outdoor PAR38-style lump holders and existing indoor standard E27 lamp holders.

It is to be understood that the word "comprising" as used throughout the specification is to be interpreted in its inclusive form, i.e. use of the word "comprising" does not exclude the addition of other element. Various modifications of and/or additions to the invention can be made without departing from the basic nature of the invention and these modifications and/or additions are therefore considered to fall within the scope of the invention.

What is claimed is:

1. A spotlight for outdoor use, the spotlight comprising:

a base having an electrical contact area at a proximal side of the housing, the electrical contact being configured for connecting to an electrical socket;

a weatherproof housing joined to a distal side of the base and shaped for sealing engagement with a mains voltage outdoor lamp holder to protect the electrical contact area of the base and the socket from contamination;

a step-down device for reducing an incoming mains voltage to an LED voltage, the step-down device being contained in the housing and protected against weather by the weatherproof housing;

an LED chamber having a proximal side thereof facing a distal side of the housing, the LED chamber containing one or more LEDs powered by the LED voltage, spacers extending from the housing to the LED chamber, so as to define an air gap separating the housing from the LED chamber, the air gap allowing free-flowing ambient cooling air to flow between the step-down device and the LED chamber, the spacers being integral with a lid of the housing located over the step-down device and facing the proximal side of the LED chamber and containing passages which provide paths for electrical leads from the step-down device to the one or more LEDs; and one or more heat-sink elements in contact with the LED chamber and the air gap, the heat sink being configured for conducting heat away from the one or more LEDs to air flowing over exposed surfaces of the heat sink;

wherein the distal and proximal sides of the air gap are flat so as to ensure drainage of the air gap.

2. A spotlight as claimed in claim 1, wherein:

the LED chamber protects the air gap from weather influences when the spotlight is disposed with the LED chamber facing upward; and the housing protects the air gap from weather influences when the spotlight is disposed with the LED chamber facing downward.

3. A spotlight as claimed in claim 1, wherein the heat-sink elements include a one-piece metal dish for heat emission to the ambient air, the dish surrounding the LED chamber.

4. A spotlight as claimed in claim 3, wherein the metal dish is made from an aluminum alloy 2-4 mm thick, or from another metal with equivalent thermal conductivity.

5. A spotlight as claimed in claim 3, wherein the metal dish has ventilation passages in the central area, which open into the LED chamber for internal ventilation against condensation.

6. A spot light as claimed in claim 3 wherein the metal dish and the LED chamber have a dark coating to increase emissivity.

7. A spot light as claimed in claim 3, wherein the metal dish comprises a smooth finless surface extending outward from a base of the dish positioned adjacent to the outside of the LED chamber, the dish having openings for air flow and drainage, the openings being positioned adjacent to the outside of the LED chamber.

8. A spotlight as claimed in claim 1, wherein the one or more LEDs are attached to a central portion of a floor of the LED chamber.

9. A spotlight as claimed in claim 1, further comprising directional reflectors including any one or more of: one reflector for the LEDs, reflectors for groups of LEDs, and individual collimators for individual LEDs.

10. A spotlight as claimed in claim 1, comprising:

a distal portion located on the distal side of the air gap and comprising the heat-sink elements made of metal; and a proximal portion located on the proximal side of the air gap and made of UV-stabilized plastics, wherein the metal distal portion is attached to the distal end of the plastic proximal portion across the air gap, and an electrical connection cap is attached to the proximal surface of the plastic proximal portion to form the base and electrical connection point.

11. A spotlight as claimed in claim 1, wherein the lid over the step-down device includes a rim flange at the lid's distal end for confining adhesive used during assembly.

12. A spotlight as claimed in claim 1, wherein the step-down device comprises an insulated switch mode transformer for universal AC input of 90-264V, 47-64 Hz at an ambient temperature of about −40° C. to about +50° C. and a constant current DC ELV output embedded in permanent elastic potting for uniform heat distribution and to provide double insulation in combination with a plastics enclosure.

13. A spotlight as claimed in claim 1, further comprising a removable transparent cover attached to the chamber using a weather-proof annular seal made from UV stabilized elastic material.

14. A spot light as claimed in claim 13, wherein the weather-proof annular seal has one dust-protected and insect-protected vent for condensation inhibition, wherein the annular seal can be rotated to face the vent downwards regardless of the installed spotlight orientation.

15. The spot light as claimed in claim 14, wherein the vent is internally fitted with a dust filter treated with surface spray insect repellant to prevent entry of insects, and wherein the filter is held in position by silicon glue.

16. A spotlight as claimed in claim 1, wherein the base is configured for engagement with a socket of the mains voltage outdoor lamp holder, and/or with a socket of an indoor lamp holder.

17. A spotlight as claimed in claim 1 where the spotlight is a fully compatible substitute for a PAR38 reflector lamp, the spotlight having a light output similar to a light output of the PAR 38 reflector lamp, being suitable for use both indoors and outdoors, being suitable for use in conjunction with the weatherproof PAR38-style lamp holder in all weather conditions regardless of the direction in which the spotlight is aimed, and having dimensions equal to or less than dimensions of a PAR38 lamp.

18. A spotlight as claimed in claim 1, wherein the LEDs are in an LED spotlight cluster or array.

19. A spotlight as claimed in claim 1, comprising a vent opening located on the proximal side of the LED chamber, for providing weather protected ventilation to the LED chamber.

20. A spotlight according to claim 19, wherein the vent opening is internally fitted with a dust filter treated with surface spray insect repellant to prevent entry of insects, and wherein the filter is held in position by silicon glue.

* * * * *